US006768395B1

(12) United States Patent
Speldrich et al.

(10) Patent No.: US 6,768,395 B1
(45) Date of Patent: Jul. 27, 2004

(54) POLARIZATION SEPARATING FILTER HAVING A POLARIZATION SEPARATING PLATE

(75) Inventors: Werner Speldrich, Backnang (DE); Uwe Rosenberg, Backnang (DE)

(73) Assignee: Marconi Communications GmbH, Backnang (DE)

( * ) Notice: Subject to any disclaimer, the term of this patent is extended or adjusted under 35 U.S.C. 154(b) by 0 days.

(21) Appl. No.: 09/979,411

(22) PCT Filed: May 12, 2000

(86) PCT No.: PCT/IB00/00633

§ 371 (c)(1),
(2), (4) Date: Feb. 21, 2002

(87) PCT Pub. No.: WO00/70705

PCT Pub. Date: Nov. 23, 2000

(30) Foreign Application Priority Data

May 18, 1999 (DE) ..... 199 22 709

(51) Int. Cl.[7] ..... H01P 1/161
(52) U.S. Cl. ..... 333/137; 333/21 A
(58) Field of Search ..... 333/137, 125, 333/135, 21 A

(56) References Cited

U.S. PATENT DOCUMENTS

| | | | | |
|---|---|---|---|---|
| 2,766,430 A | | 10/1956 | Zaleski | |
| 3,932,822 A | * | 1/1976 | Salzberg | 333/125 |
| 5,977,844 A | * | 11/1999 | Baird | 333/137 X |

FOREIGN PATENT DOCUMENTS

| | | | | |
|---|---|---|---|---|
| DE | 31 11 106 A | | 9/1982 | |
| DE | 295 11 273 U | | 9/1995 | |
| EP | 0 993 064 A | | 4/2000 | |
| FR | 2 371 065 A | | 6/1978 | |
| GB | 1 507 147 A | | 4/1978 | |
| JP | 52002 | * | 3/1986 | 333/137 |
| JP | 6140810 | * | 5/1994 | 333/135 |
| WO | 8702190 | * | 4/1987 | 333/137 |

OTHER PUBLICATIONS

Hawkings G. et al: "Tracking Systems for Satellite Communications" IEE Proceedings F. Communications, Radar & Signal Processing, GB, Institution of Electrical Engineers. Stevenage, BD. 135, NR. 5, Part F, Oct. 5, 1988.
Patent Abstracts of Japan vol. 17, No. 386, Jul. 20, 1993 & JP 05 067902 A, Mar. 19, 1993.

* cited by examiner

*Primary Examiner*—Benny Lee
(74) *Attorney, Agent, or Firm*—Michael J. Striker

(57) ABSTRACT

A polarization separating filter, which can be integrated into a planar hollow waveguide circuit, is comprised of a central hollow waveguide (1), in which two orthogonal, linearly polarized waves can be propagated, where one end of the central hollow waveguide (1) is closed by a short circuit wall (2) and in the vicinity of the short circuit wall (2), two waveguides (3, 4) are coupled to two opposing walls of the central hollow waveguide (1), in an at least approximately identical cross sectional plane extending perpendicular to the longitudinal axis of the hollow waveguide. The hollow waveguides (3, 4) coupled at the end of the central hollow waveguide (1) are rotated in relation to each other in terms of their cross sections so that the fields in them are oriented orthogonally to each other.

3 Claims, 4 Drawing Sheets

POLARIZATION SEPARATING FILTER HAVING A POLARIZATION SEPARATING PLATE

BACKGROUND OF THE INVENTION

The current invention relates to a polarization separating filter, comprised of a central hollow waveguide in which two linear, orthogonally polarized waves can be propagated, where one end of the central hollow waveguide is dosed by a short circuit wall and in the vicinity of the short circuit wall, two waveguides are coupled to two opposing walls of the central hollow waveguide, in an at least approximately identical cross sectional plane extending perpendicular to this longitudinal axis of the hollow waveguide. A polarization separating filter of this kind has been disclosed by DE 31 11 106 C1, which discloses a rectangular hollow waveguide and a coaxial conductor in the same cross sectional plane are coupled to two opposing walls of a central hollow waveguide, which has a round or square cross section. The coupling of a coaxial conductor is expensive in manufacture and assembly since this requires special individual parts that must be manufactured with high precision (e.g. internal conductors, support disks, etc.). Since there are waveguide connection gates in standard uses of polarization separating filters, extra coaxial/waveguide transitions must be provided, as a result of which favorable reflection properties can only be achieved with difficulty.

The object of the invention, therefore, is to disclose a polarization separating filter of the type mentioned at the beginning, which can be manufactured as inexpensively as possible and which also has very favorable electrical properties.

SUMMARY OF THE INVENTION

The stated object is attained by virtue of the fact that the two waveguides are hollow waveguides, which are coupled at one end on opposite sides of the central hollow waveguide, where the hollow waveguides are dimensioned so that only the fundamental wave type can be propagated in the hollow waveguides and so that the two hollow waveguides are rotated relative to one another around their longitudinal axes so that the electromagnetic fields of the two hollow waveguides are oriented orthogonal to each other.

Since all of the hollow waveguides of this polarization separating filter are disposed in one plane, they can be integrated into a planar hollow waveguide circuit. The central hollow waveguide and the hollow waveguides coupled to the central hollow waveguide are produced as shells that are introduced into the bottom and top of a housing. Due to the compact design, it is also possible to manufacture the polarization separating filter completely out of one piece by forming a base body from the connecting sides of the hollow waveguide gates of the central hollow waveguide and of the hollow waveguides coupled to the sides of the central hollow waveguide.

Thus the two hollow waveguides can be coupled to the central hollow waveguide via orifices in order to produce as broad-band a coupling as possible. In the central hollow waveguide, at least one rod can be disposed in the coupling region of the two hollow waveguides.

It is useful for a separating plate to extend in the central hollow waveguide, from the short circuit wall into the coupling region of the two laterally coupled hollow waveguides, the separating plate being oriented perpendicular to the longitudinal axes of the coupled hollow waveguides. In the central hollow waveguide, at least in the coupling region of a lateral hollow waveguide, a strut can be provided in the angle between the separating plate and the short circuit wall.

In another embodiment, the lateral hollow waveguides have a rectangular cross section and the hollow waveguide, whose broad sides are oriented perpendicular to the longitudinal axis of the central hollow waveguide, is coupled to the central hollow waveguide by means of an E-plane bend, where the E-plane bend is comprised of a contour, which is provided in the central hollow waveguide and simultaneously constitutes a dividing wall that extends from the short circuit wall into the coupling plane of the two lateral hollow waveguides and is oriented perpendicular to the longitudinal axes of the laterally disposed hollow waveguides. This arrangement achieves an optimal decoupling of the two polarizations coupled via the lateral hollow waveguides.

BRIEF DESCRIPTION OF THE DRAWINGS

The invention will be explained in detail below in conjunction with several exemplary embodiments shown in the drawings where like features are designated by the same reference numbers.

DETAILED DESCRIPTION OF THE PREFERRED EMBODIMENT

Figure 1:
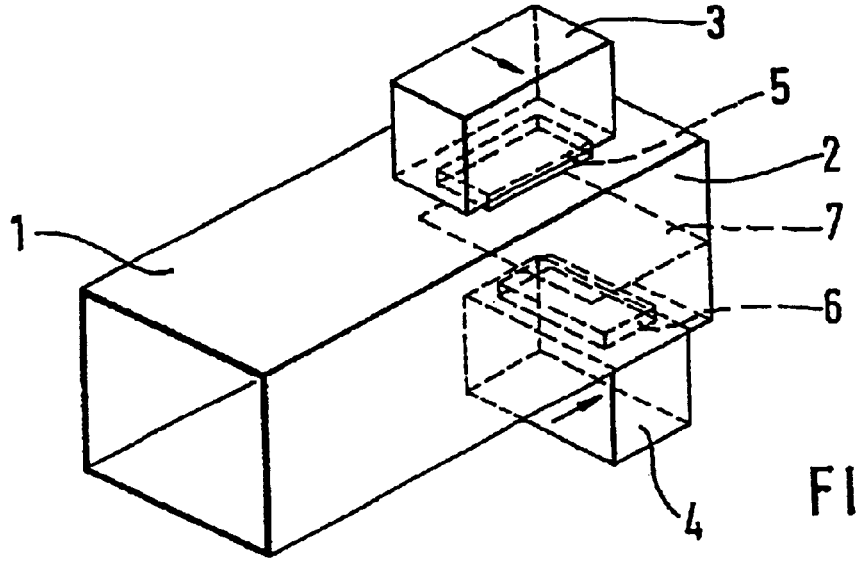
FIG. 1 is a perspective depiction of a polarization separating filter, with a separation plate in a central, square hollow waveguide.

FIG. 1 is a perspective representation of a polarization separating filter, which has a central hollow waveguide 1, which is connected at one end to a short circuit wall 2. The central, rectangular hollow waveguide 1 shown has a square cross section so that two linear, orthogonally polarized waves H01 and H10 can be propagated in it. In order to be able to couple these two polarizations to the central hollow waveguide 1, two rectangular hollow waveguides 3 and 4 are coupled to two opposing side walls of the central hollow waveguide 1. These laterally coupled rectangular hollow waveguides 3 and 4 are dimensioned so that only the fundamental wave type H01, H10 can be propagated in them. The arrows shown in the cross sections of the two rectangular hollow waveguides 3 and 4 indicate the polarizations associated with them. Both of the rectangular hollow waveguides 3 and 4 are coupled in an at least approximately identical cross sectional plane extending to the longitudinal axis of the central hollow waveguide 1. The distance of this cross sectional plane from the short circuit wall 2 in this exemplary embodiment is approximately ⅛the hollow waveguide wavelength at the average operating frequency and can, as explained below, also be different for the two hollow waveguide gates. In order to definitely separate the two polarizations, the two rectangular hollow waveguides 3 and 4 are rotated 90° in relation to each other with regard to their cross sections.

In order to produce as broad-band as possible a coupling of the rectangular hollow waveguides 3 and 4 to the central hollow waveguide 1, the rectangular hollow waveguides 3 and 4 are coupled to the central hollow waveguide 1 via orifices 5 and 6. In the central hollow waveguide 1, a separating plate 7 extends from the short circuit wall 2 into the coupling region between the two rectangular hollow waveguides 3 and 4. The introduction of such a separating plate 7 permits the electrical short circuit planes for the two polarization couplings to be optimized in a largely independent fashion. The electrical short circuit plane for the rectangular hollow waveguide 3, whose broad sides are disposed parallel to the longitudinal axis of the central hollow waveguide 1, is essentially determined by the length of the separating plate. The electrical short circuit plane for the other rectangular hollow waveguide 4, whose broad sides are disposed perpendicular to the longitudinal axis of the central hollow waveguide 1, is essentially determined by the partial region of the short circuit wall 2 disposed between the separating plate 7 and the rectangular hollow waveguide 4. The separating plate 7 also provides for a favorable decoupling between the two polarizations. In addition, the separating plate 7 can be provided with a contour that is stepped in the direction of the longitudinal axis of the central hollow waveguide 1, which permits better adaptation properties to be achieved.

Figure 2A:
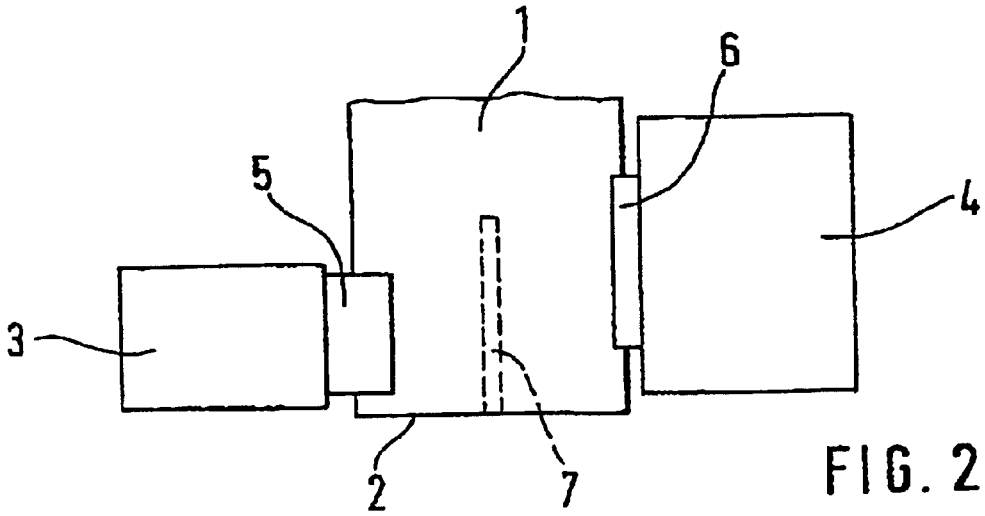
FIGS. 2*a*, 2*b* show two views of a polarization separating filter, with a separation plate in a central, round hollow waveguide.
Figure 2B:
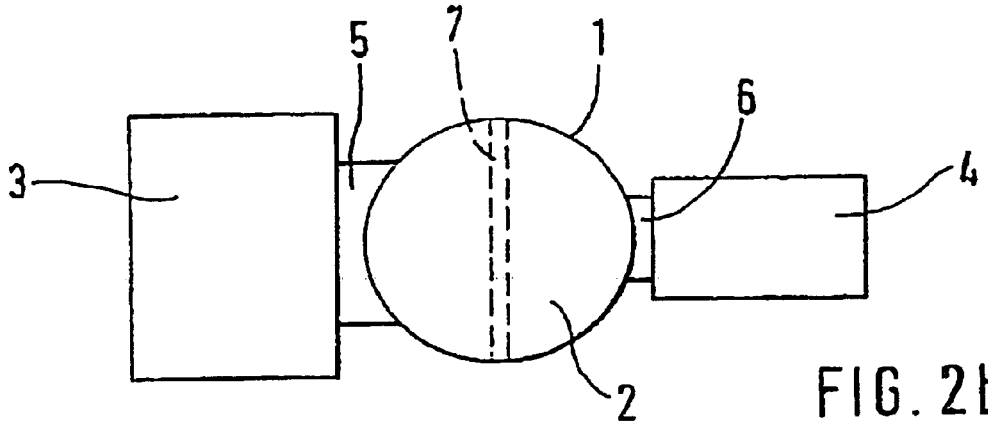

The central hollow waveguide 1 of the polarization separating filter can also be a round hollow waveguide, as depicted in a top view shown in FIG. 2*a* and in a front view of the short circuit wall 2 shown in FIG. 2*b*. Parts that are the same as those described above in FIG. 1 have been provided with the same reference numerals in FIGS. 2*a* and 2*b*. In the figures described below, parts that remain the same are also provided with the same reference numerals.

Figure 3A:
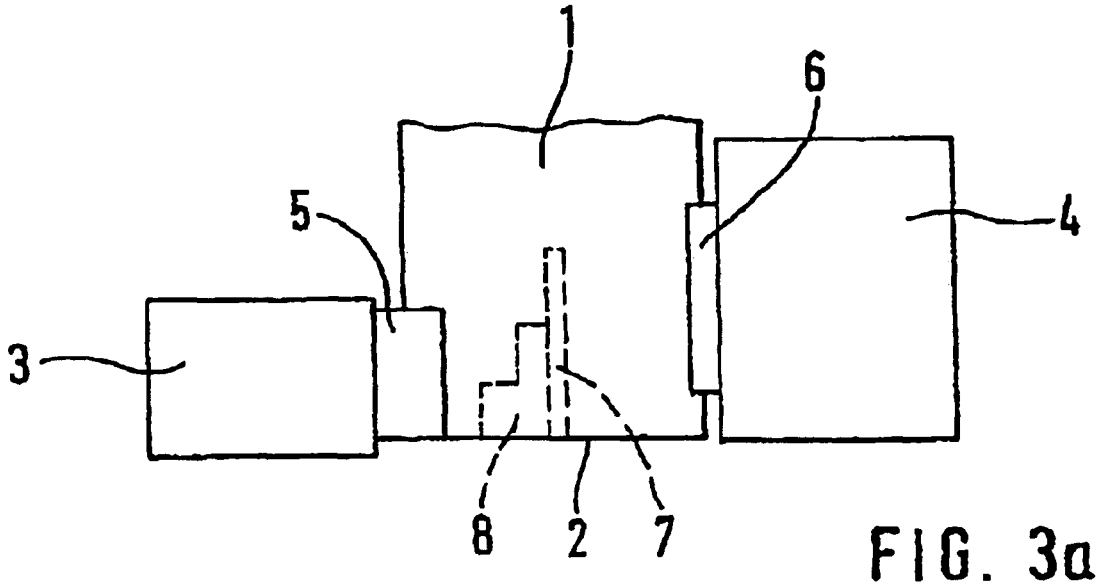
FIGS. 3*a*, 3*b* show two views of a polarization separating filter, with a separation plate and a strut in a central, round hollow waveguide.
Figure 3B:
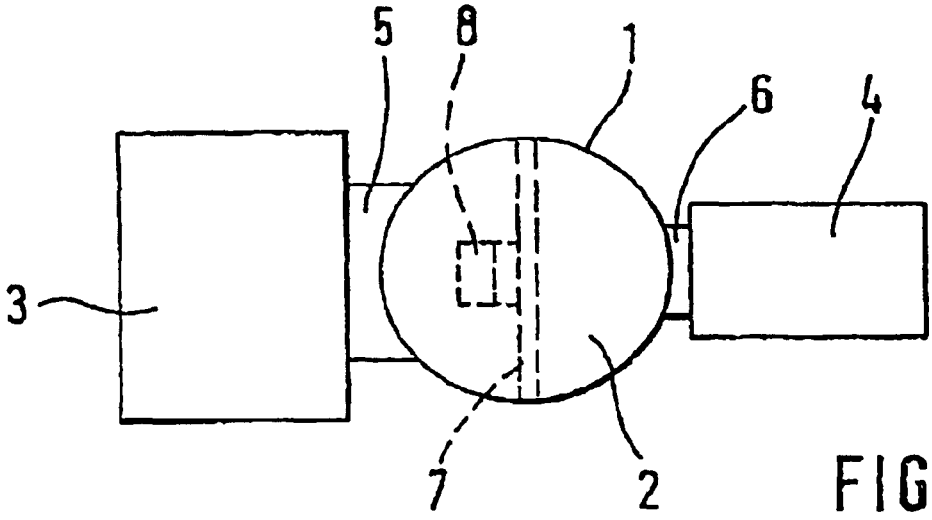

FIGS. 3*a* and 3*b* correspond to FIGS. 2*a* and 2*b*, the difference being that with the polarizations separating filter shown in FIGS. 3*a*, 3*b*, a stepped strut 8 is disposed between the separating plate 7 and the coupled rectangular hollow waveguide 3, in the angle between the short circuit wall 2 and the separating plate 7. The presence of the strut 8 achieves a transformation between the wave type of the central hollow waveguide and the fundamental wave type coupled from it through the hollow waveguide 3, where the electromagnetic field in the central hollow waveguide 1 is simultaneously curved toward the lateral hollow waveguide 3. As a result, the realization of favorable electrical properties in a broad frequency band is significantly improved. The strut 8 can also protrude beyond the separating plate 7 in the direction of the longitudinal axis of the central hollow waveguide 1 since it only has a negligible influence on the properties of the orthogonal polarization that is coupled to the other lateral hollow waveguide 4. It is also possible for a part of the strut 8 to protrude into the orifice 5 of the hollow waveguide 3.

Figure 4A:
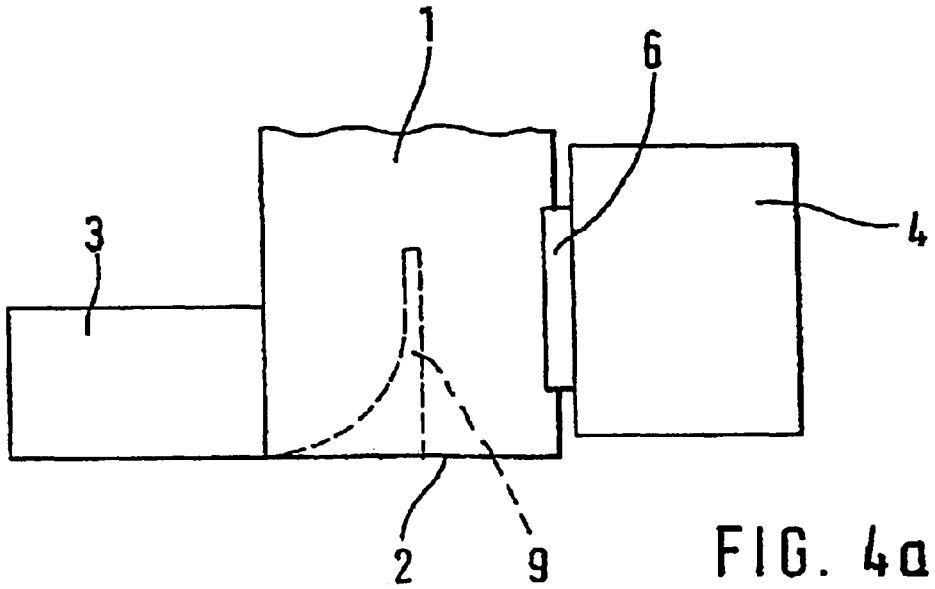
FIGS. 4*a*, 4*b* show two views of a polarization separating filter, with an E-bend in a central, round hollow waveguide.
Figure 4B:
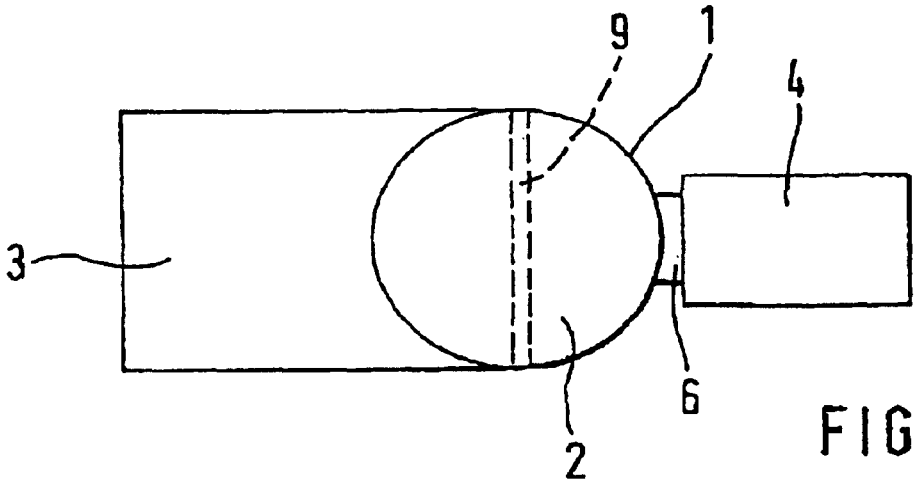

In the polarization separating filter shown in FIG. 4*a* (top view) and FIG. 4*b* (front view), an E-plane bend 9 is integrated into the central hollow waveguide 1 for the rectangular hollow waveguide 3, whose broad sides extend at right angles to the longitudinal axis of the central round hollow waveguide 1. The E-plane bend 9 is constituted by a contour, which is provided in the central round hollow waveguide 1 and simultaneously constitutes a dividing wall, which extends from the short circuit wall 2 into the coupling plane of the two rectangular hollow waveguides 3 and 4 and is oriented perpendicular to the longitudinal axes of the rectangular hollow waveguides 3 and 4. Like the stepped strut 8 in FIG. 3, this E-plane bend 9 produces a curvature of the electromagnetic field of the wave type of the central hollow waveguide 1, which is coupled into the lateral hollow waveguide 3 and therefore improves the electrical properties of the coupling. The E-plane bend 9 can also be embodied in the form of several stages.

Figure 5A:
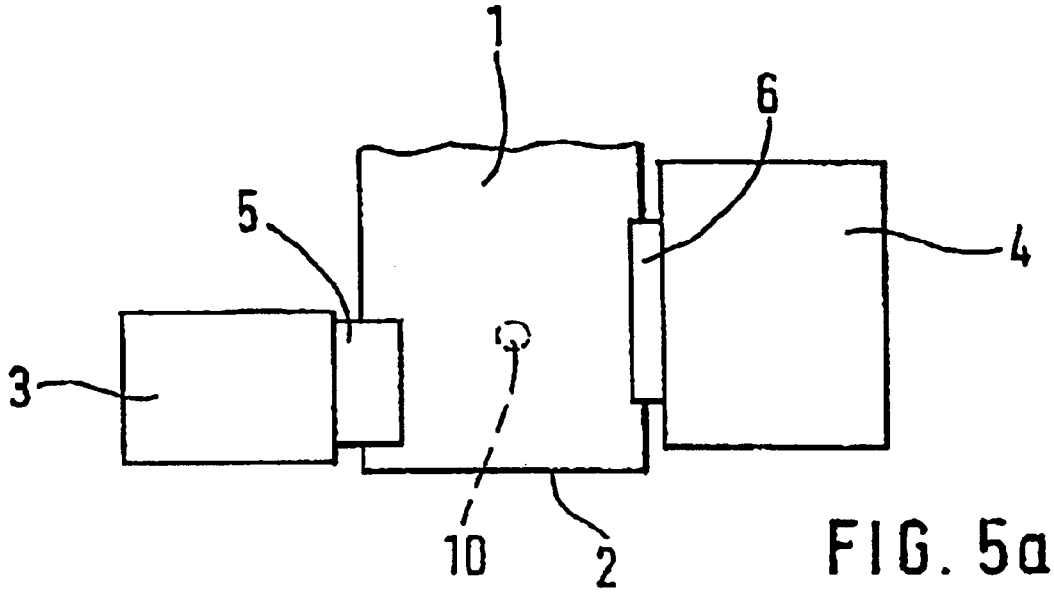
FIGS. 5*a*, 5*b* show two views of a polarization separating filter, with a pin in a central, round hollow waveguide.
Figure 5B:
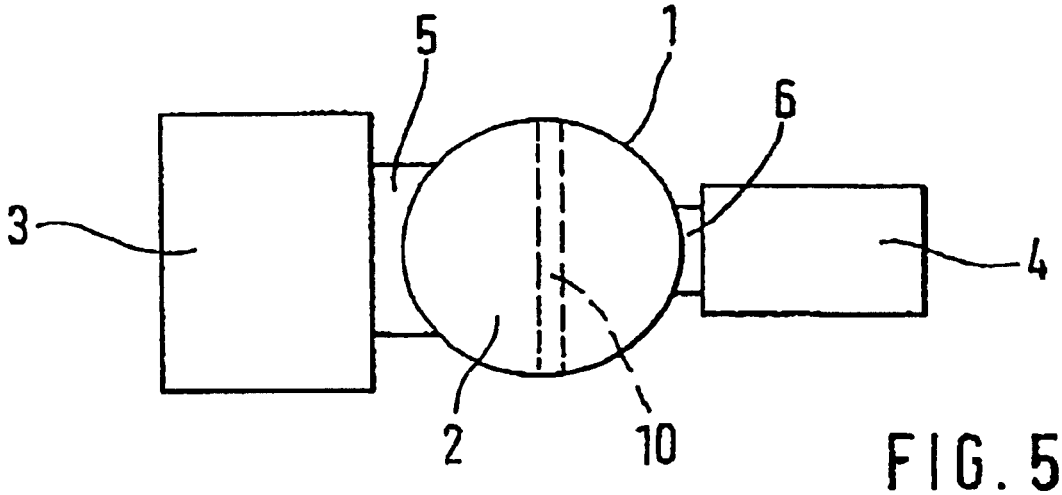

FIGS. 5*a* and 5*b* show that in the central hollow waveguide 1, a pin 10 is provided in the coupling region between the two rectangular hollow waveguides 3 and 4. This pin helps improve the adaptation of the coupled rectangular hollow waveguides 3 and 4. Several pins or other discontinuities can also be provided in the coupling region between the two rectangular hollow waveguides 3 and 4 in order to improve the adaptation.

When rectangular hollow waveguides are mentioned in the preceding description, this is also intended to mean hollow waveguides with rectangle-like cross sections (e.g. rectangular with rounded edges, elliptical, and the like), in which wave types can be propagated that are similar to those that can be propagated in purely rectangular hollow waveguides. By contrast with the exemplary embodiments shown in FIGS. 2*a*, 2*b*, 3*a*, 3*b*, 4*a*, 4*b*, 5*a*, 5*b*, the central hollow waveguide 1 can also have a square cross section or a cross section that deviates from round or square, which in any case, permit two orthogonal, linearly polarized waves to be propagated.

The above-described polarization separating filter can also be operated as a so-called frequency polarization separating filter in which the orthogonal polarizations are designed for different frequency ranges.

What is claimed is:

1. A polarization separating filter, comprised of a central hollow waveguide (1), in which two orthogonal, linearly polarized waves can be propagated, where one end of the central hollow waveguide (1) is closed by a short circuit wall (2) and in the vicinity of the short circuit wall (2), two waveguides (3, 4) are coupled to two opposing wall segments of the central hollow waveguide (1) so that the waveguides are diametrically opposed, in an at least approximately identical cross sectional plane extending perpendicular to the longitudinal axis of the hollow waveguide, wherein the two waveguides are hollow waveguides (3, 4) which are dimensioned so that only the fundamental wave type can be propagated in the hollow waveguides and that the two hollow waveguides (3, 4) are oriented relative to one another so that the electromagnetic fields of the two hollow waveguides (3, 4) are oriented orthogonally to each other, wherein in the central hollow waveguide (1), a separating plate (7) extends from the short circuit wall (2) into the coupling region of the two hollow waveguides (3, 4), wherein the separating plate (7) is oriented perpendicular to the longitudinal axes of the coupled hollow waveguides (3, 4), wherein the separating plate (7) extends at a distance from the short circuit wall, such that the longitudinal axis of the hollow waveguides (3, 4) virtually penetrate the separating plate.

2. The polarization separating filter according to claim 1, wherein the two hollow waveguides (3, 4) are coupled to the central hollow waveguide (1) via orifices (5, 6).

3. The polarization separating filter according to claim 1, wherein in the central hollow waveguide (1), at least in a coupling region of one of the two hollow waveguides (3, 4), a strut (8) is disposed in the angle between the separating plate (7) and the short circuit wall (2).

* * * * *

UNITED STATES PATENT AND TRADEMARK OFFICE

CERTIFICATE OF CORRECTION

PATENT NO. : 6,768,395 B1
APPLICATION NO. : 09/979411
DATED : July 27, 2004
INVENTOR(S) : Speldrich et al.

It is certified that error appears in the above-identified patent and that said Letters Patent is hereby corrected as shown below:

On the Title Page, Item (54), in Title, Lines 1-3, delete "POLARIZATION SEPARATING FILTER HAVING A POLARIZATION SEPARATING PLATE" and insert -- POLARIZATION SEPARATING FILTER --, therefor.

In Column 1, Lines 1-3, delete "POLARIZATION SEPARATING FILTER HAVING A POLARIZATION SEPARATING PLATE" and insert -- POLARIZATION SEPARATING FILTER --, therefor.

In Column 1, Line 10, delete "dosed" and insert -- closed --, therefor.

In Column 2, Line 32, delete "waveguide." and insert -- waveguide, --, therefor.

In Column 2, Line 35, delete "waveguide." and insert -- waveguide, --, therefor.

In Column 2, Line 37, delete "waveguide." and insert -- waveguide, --, therefor.

Signed and Sealed this

Eleventh Day of November, 2008

JON W. DUDAS
*Director of the United States Patent and Trademark Office*